US005377906A

United States Patent [19]

Mason

[11] Patent Number: 5,377,906

[45] Date of Patent: Jan. 3, 1995

[54] DEVICE FOR DETECTING AND SIGNALLING THE PRESENCE OF OBJECTS IN A CLOSED CONTAINER AND A MAILBOX CONTAINING THE SAME

[76] Inventor: Randall Mason, 1010 Rock Dr., Raleigh, N.C. 27610-3140

[21] Appl. No.: 143,070

[22] Filed: Oct. 29, 1993

[51] Int. Cl.[6] ..... B65D 91/00

[52] U.S. Cl. ..... 232/34; 340/569

[58] Field of Search ..... 232/34, 35, 36; 340/569

[56] References Cited

U.S. PATENT DOCUMENTS

| | | | |
|---|---|---|---|
| 2,835,887 | 5/1958 | Seeley et al. | 340/569 |
| 2,968,804 | 1/1961 | Buffington | 340/569 |
| 4,314,102 | 2/1982 | Lowe et al. | 340/569 |
| 4,633,236 | 12/1986 | Buhl | 340/569 |
| 4,794,377 | 12/1988 | Benages | 340/569 |
| 4,868,543 | 9/1989 | Binkley | 340/569 |
| 4,999,612 | 3/1991 | Cherveny | 340/569 |
| 5,036,310 | 7/1991 | Russell | 340/569 |

FOREIGN PATENT DOCUMENTS

| | | | |
|---|---|---|---|
| 2245951 | 3/1974 | Germany | 232/34 |

*Primary Examiner*—Michael J. Milano

*Attorney, Agent, or Firm*—Oblon, Spivak, McClelland, Maier & Neustadt

[57] ABSTRACT

A device for detecting and signalling the presence of an object in a closed container, comprising:

a housing;

one or more sensors each comprising an electronic circuit having a detector and an optical signal trigger, wherein the one or more sensors are coupled to the housing;

a power source electrically connected to the one or more sensors; and an optical signal electrically connected to the optical signal trigger, and its use in providing an electronic mailbox which allows an observer to detect the presence of mail from a remote location.

14 Claims, 3 Drawing Sheets

DEVICE FOR DETECTING AND SIGNALLING THE PRESENCE OF OBJECTS IN A CLOSED CONTAINER AND A MAILBOX CONTAINING THE SAME

BACKGROUND OF THE INVENTION

1. Field of the Invention

The present invention relates to a device for detecting objects in a closed container and its use in providing an "electronic mailbox" which allows remote detection of mail present in the box.

2. Discussion of the Background

In many parts of the United States, especially rural areas, mailboxes are remotely located with respect to the residence of the person to whom the mailbox belongs. Often this distance can be as much as several hundred yards or more, making it necessary to travel outside, often in inclement weather, in order to determine if mail is present.

Previous attempts to provide a device which indicates the presence of mail in the mailbox have been primarily mechanical devices, ranging from flags that pop up when the door of the mailbox is open, to springs with small ribbons on them. These previous attempts rely on the opening of the door of the mailbox as a signal that mail has been placed in the box. However, such an approach does not work if the door has been inadvertently opened and closed, if the springs or flags have not been reset or at night.

Benages, U.S. Pat. No. 4,794,377, discloses one solution which has been proposed. In Benages, a device is disclosed which is attached to the mailbox and detects the presence of mail by using an optical sensor which requires either a radio-frequency transmitter and receiver to indicate the presence of mail in the mailbox or requires that the mailbox be directly wired to the electrical wiring of the residence. The optical sensor uses a photodiode attached to the top of the mailbox which receives a signal from an infrared emitter located on the bottom of the mailbox. The presence of mail in the box interrupts the signal from the emitter to the photodiode and triggers the radio transmitter to notify the receiver.

However, since many rural areas have high voltage power lines which generate electrical fields, many remote mailboxes are located adjacent to highways with heavy traffic among which are numerous cellular phones and radios, and countless other sources of potential radio frequency interference, the signal from the device of Benages can be disturbed to provide false negative or false positive signals. Additionally, the device of Benages requires modification of the mailbox and correct alignment of the components of the optical sensor. If security is a concern, the device of Benages suffers from the disadvantage that radio frequency scanners can intercept the signal produced.

Accordingly a device is needed which can detect and signal the presence of objects, such as mail, in a remotely located container, such as a mailbox, which does not suffer from the above-noted disadvantages, which is easy to install and has very low power consumption.

SUMMARY OF THE INVENTION

Accordingly, one object of the present invention is to provide a device for detecting and signalling the presence of an object in a remotely located container which can be simply installed without modification to the container.

A further object of the present invention is to provide a device for detecting and signalling the presence of an object in a remotely located container which does not require a separate receiver for the signal produced.

A further object of the present invention is to provide a device for detecting and signalling the presence of an object in a remotely located container which provides no false positive signals.

A further object of the present invention is to provide a device for detecting and signalling the presence of an object in a remotely located container which does not suffer from signal interference and which signal can be detected from distances of up to 2000 yards.

A further object of the present invention is to provide an electronic insert for a remotely located mailbox which detects and signals the presence of mail with the abovementioned advantages.

These and other objects of the present invention have been satisfied by the discovery of a device for detecting and signalling the presence of an object in a closed container, comprising:

a housing;

one or more sensors each comprising an electronic circuit having a detection means and an optical signal triggering means, wherein the sensors are coupled to the housing;

a power source electrically connected to the sensors; and an optical signalling means electrically connected to the optical signal triggering means, and its use in providing an "electronic mailbox" which allows an observer to detect the presence of mail from a remote location.

BRIEF DESCRIPTION OF THE FIGURES

A more complete appreciation of the invention and many of its attendant advantages will be readily obtained as the same become better understood by reference to the following detailed description when considered in connection with the accompanying drawings, wherein.

DETAILED DESCRIPTION OF THE PREFERRED EMBODIMENTS

Figure 1:
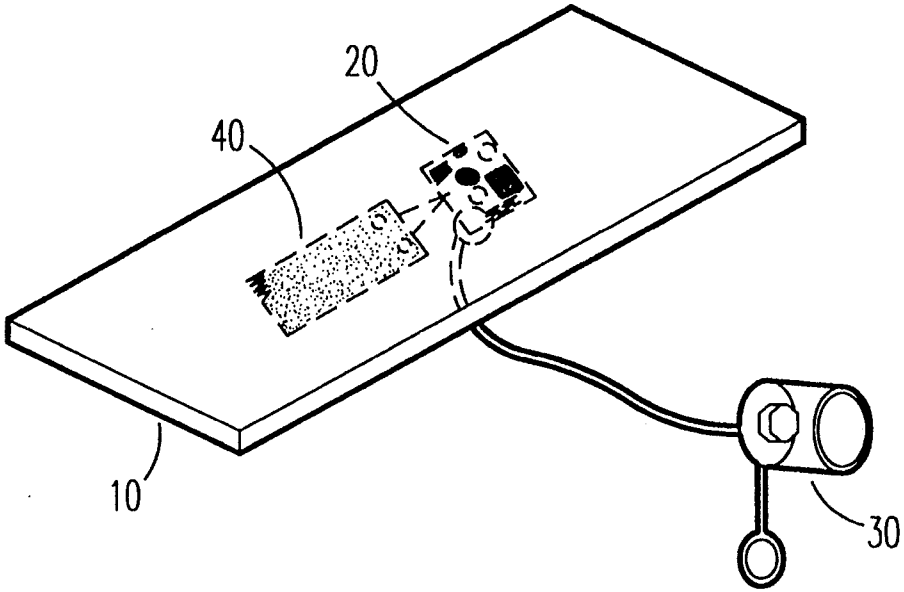
FIGS. 1–2 provide a representation of preferred embodiments of the present device showing the housing (10), sensor(s) (20), optical signalling means (30), power source (40) and the mailbox (50) within which the device is placed.

The present invention relates to a device for detecting and signalling the presence of an object in a closed container, comprising:

a housing;

one or more sensors each comprising an electronic circuit having a detection means and an optical signal triggering means, wherein the sensors are coupled to the housing;

a power source electrically connected to the sensors; and an optical signalling means electrically connected to the optical signal triggering means.

The housing of the present invention may be of any desired shape or size, so long as the housing will completely fit inside the container in which objects to be detected will be placed and will provide an approximately flat surface against which the object to be detected will rest. In a most preferred embodiment, the housing is a bottomless, hollow rectangular box with dimensions of approximately 46 cm in length, 15.5 cm in width and 2 cm in height.

The housing is prepared from any material which is sufficiently stiff to provide protection for the circuitry of the present invention. Suitable materials include stiff cardboard or any moldable plastic, such as polystyrene, polyvinylchloride, polyester, polyamides, polyolefins or copolymers or blends thereof. While virgin polymers, copolymers or blends may be used, the housing is preferably prepared from recycled polymer feedstock in order to reduce manufacturing costs. The polymers used may optionally contain conventional fillers, additives and colorants, if desired. The housing can be prepared by a variety of molding processes, such as injection molding, blow molding, vacuum forming, rotary powder molding or compression molding..

The electronic circuit of the present invention comprises two components: a detection means and an optical signal triggering means. The detection means of the present invention is preferably a photomicrosensor which contains both a transmitter and a detector, preferably an infrared transmitter and infrared detector. The transmitter emits a signal, preferably in the infrared frequency, which when reflected by an object, such as mail, strikes the detector and indicates to the optical signal triggering means that an object is present.

In a preferred embodiment, the detection means is an infrared photomicrosensor which has an adjustable focal point. The focal point of the photomicrosensor can be adjusted to any height less than the height of the container, and is preferably adjusted to detect the presence of objects at a distance of from 0.1 cm to 15 cm, more preferably from 0.1 cm to 5 cm, most preferably at a height of about 0.25 cm above the surface of the housing.

The detection means may be located on the top surface of the housing (the surface on which the object to be detected is placed), in the plane of the top surface of the housing or below the top surface of the housing. When the detection means is located in the plane of the top surface or below the top surface of the housing, there must be an opening in the top surface of the housing through which the transmitter and detector can operate.

The optical signal triggering means provides an electrical impulse which is generated in response to detection by the detection means, wherein the electrical impulse triggers an optical signalling means. The triggering means preferably comprises a signal amplifying means in combination with a charge pump circuit which accumulates the electrical signal as it is amplified until the charge pump is saturated and creates a triggering signal which effects actuation of the optical signalling means. A preferred triggering means uses a combination of a Darlington transistor for high sensitivity connected to a capacitor which determines the flash rate of the optical signalling means. Higher capacitance in the capacitor provides a lower flash rate and vice versa.

The optical signalling means of the present invention may be any means capable of converting the triggering signal from the triggering means into an optically detectable signal having sufficient visibility to be seen from a distance of up to 300 yards in daylight or at night, preferably greater than 1000 yards, more preferably up to 2000 yards. Suitable optical signalling means include any light source including visible sources such as high intensity LEDs and xenon strobes or invisible sources such as infrared. The use of invisible sources also requires special viewing apparatus such as an infrared receiver or infrared filters. The optical signalling means preferably produces a flashing signal for easier detection by an observer in a remote location. The optical signalling means may be shrouded for increased security, for detection from a specified direction only or to prevent light wash or saturation from ambient light. The use of such a shroud and a high intensity LED having a reduced field of emission provides a decreased field of detection to less than 10 radial degrees, preferably no more than 4 radial degrees. A suitable shroud may be made from a cylinder having a single closed end through which the optical signalling means may be fitted by cutting a hole through the single closed end. The optical signalling means is preferably mounted on the outside of the container and aimed in the direction most likely to be used. The optical signalling means of the present invention may be used alone or a plurality of the optical signalling means may be used to provide the ability to detect the signal in a variety of directions and/or wavelengths.

The power source of the present invention may be any power source capable of sustaining a prolonged electrical supply to the electrical circuitry of the device of the present invention. Suitable power sources include direct current batteries, solar cells, turbines and alternating current, with direct current batteries and solar cells being preferred for the remotely located containers such as rural mailboxes. The device of the present invention has been found to operate effectively for up to 15,000 hours on two standard 1.5 volt AA batteries.

Tests of the device of the present invention when placed inside a standard rural mailbox indicate that no false positive signals (signalling the presence of mail when none is present) or false negative signals (not signalling the presence of mail when mail is actually present) were observed in over 2000 repetitions.

Figure 2:
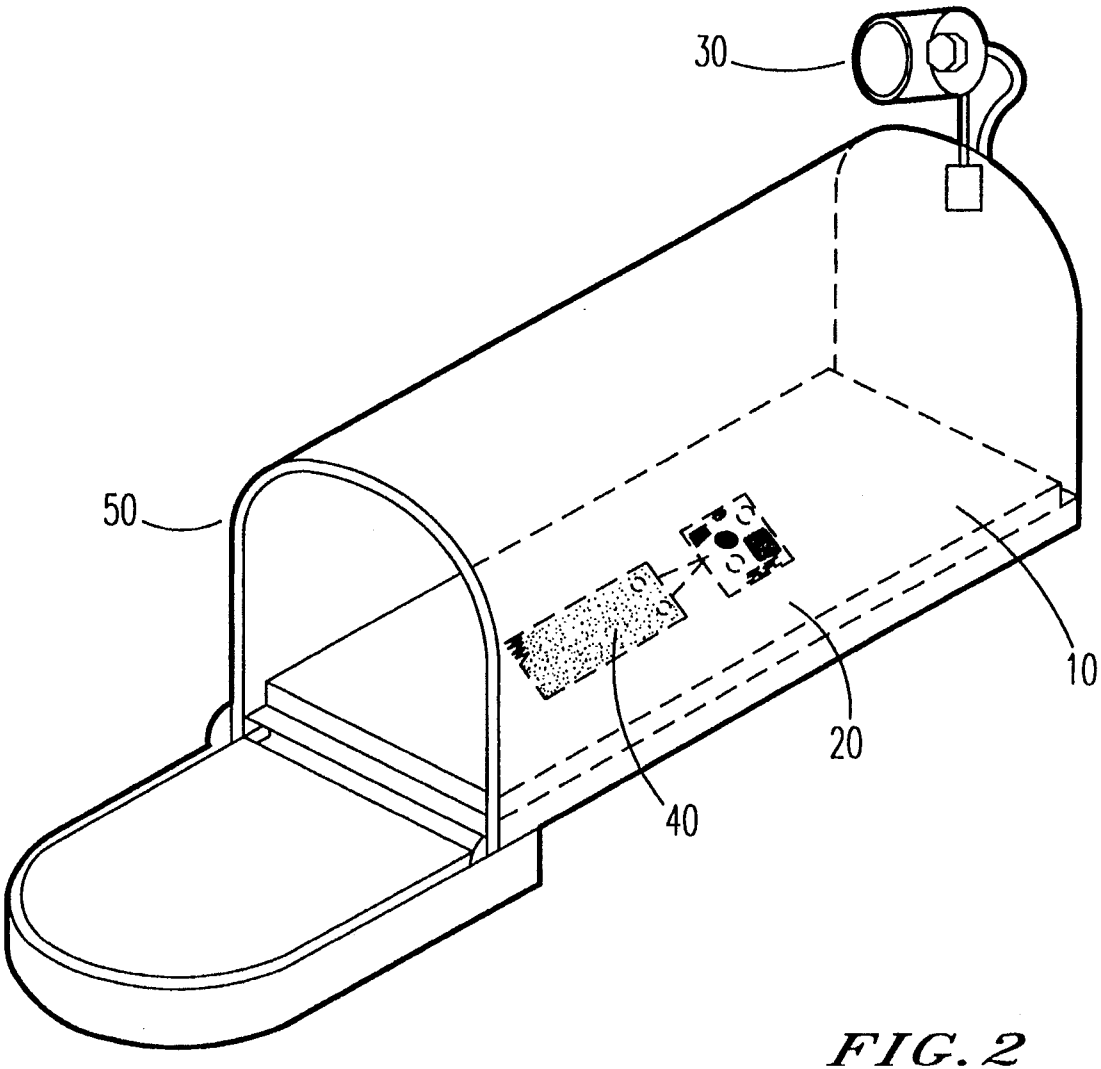

In a most preferred embodiment, the device of the present invention has a rectangular flat housing (10) with a single sensor (20) and power source (40) as shown in FIG. 1. The device is placed inside a standard mailbox (50) with the optical signalling means (30) placed on the outside of the mailbox either by the use of adhesive or by physically mounting the optical signalling means using screws or bolts as shown in FIG. 2.

Figure 3:
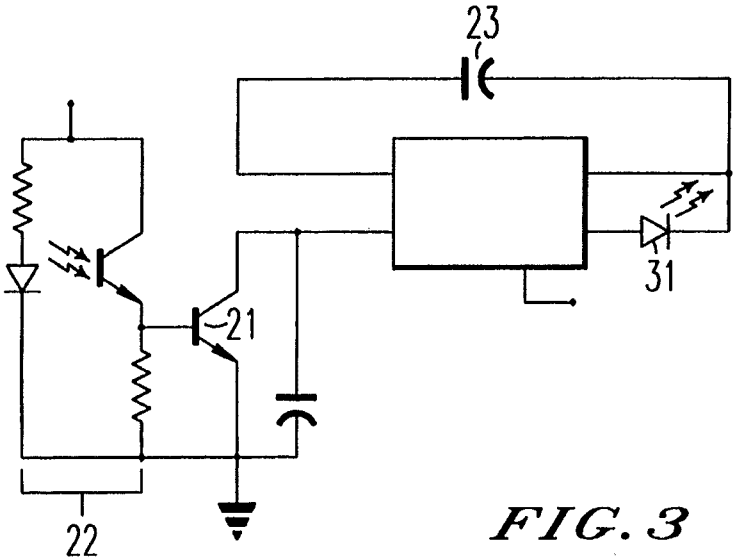
FIG. 3 provides a schematic representation of a preferred electrical circuit showing the detection means, optical signal triggering means and optical signalling means wherein the circuit contains a Darlington transistor (21), an infrared photomicrosensor (22) and a charge pump circuit having a flash rate controlling capacitor (23) and an LED optical signalling means (31) .

FIG. 3 shows a most preferred embodiment of the circuit of the present invention showing the Darlington transistor (21), the infrared photomicrosensor (22), the charge pump circuit with the flash rate controlling capacitor (23) and the LED optical signalling means (31).

Figure 4:
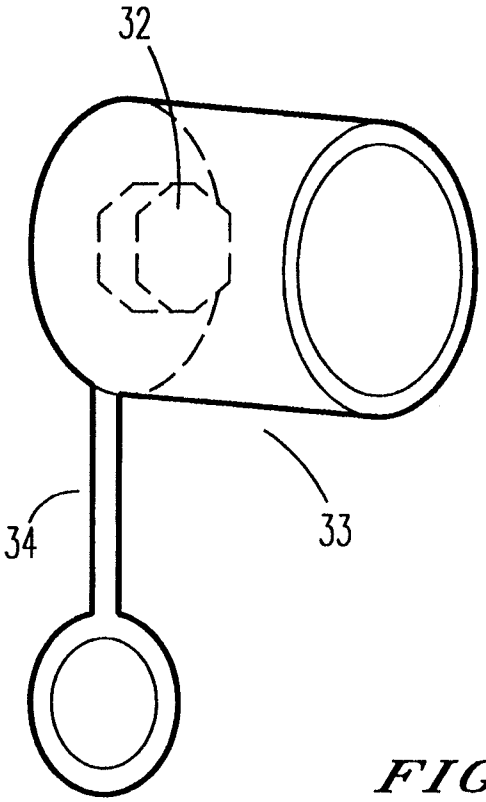
FIG. 4 shows a preferred shrouded optical signalling means with a high intensity LED (32), shroud (33) and mounting bracket (34).

FIG. 4 shows a preferred embodiment of the shrouded optical signalling means with a high intensity LED (32) mounted through a hole in the bottom of a circular cylinder having one open end (33) with a mounting bracket attached to the outside of the cylinder (34).

In a most preferred embodiment of the present invention, the device of the present invention is placed inside a standard mailbox to provide an "electronic mailbox" capable of detecting and signalling the presence of mail from a remote location. When the device of the present invention is placed in the mailbox, the device preferably is located on the inside floor surface of the mailbox, with the optical signalling means mounted on the outside of the mailbox on an external surface. However it is also possible to use the device of the present invention on a vertical side surface of the mailbox or even mounted on the inner top surface of the mailbox, although the focal height of the detector would necessarily need to adjusted for the width or depth of the mailbox in such situations. Suitable mailboxes include any standard mailbox into which the device of the present invention will fit. The mailbox may be prepared from any suitable material including, but not limited to, metals and plastics. Ideally suited for use with the device of the present invention is the standard rural mailbox (50), as exemplified in FIG. 2.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for detecting and signalling the presence of an object in a closed container, comprising:

a housing;

one or more sensors each consisting essentially of an electronic circuit having a detection means and an optical signal triggering means, wherein said one or more sensors are coupled to said housing, wherein said detection means consists of an infrared transmitter which emits an infrared signal and an infrared detector for detecting said infrared signal after said infrared signal is reflected off the object to be detected and wherein said optical signal triggering means consists of an electrical circuit having an amplifying transistor in electrical connection with a capacitor which functions as a charge pump circuit for triggering said optical signalling means to generate a signal;

a power source electrically connected to said one or more sensors; and an optical signalling means electrically connected to said optical signal triggering means.

2. The device of claim 1, wherein said infrared transmitter and said infrared detector have an adjustable focal point of from 0.1 to 15 cm.

3. The device of claim 1, wherein said optical signalling means is a high-intensity LED.

4. The device of claim 1, wherein said optical signalling means is a xenon strobe.

5. The device of claim 1, wherein said housing has a shape of a rectangle with said one or more sensors being a single sensor placed in the approximate center of the rectangle relative to both a long and short axis of the rectangle.

6. The device of claim 1, wherein said power source is a member selected from the group consisting of batteries, solar cells, alternating current and turbines.

7. The device of claim 1, wherein said optical signalling means has a field of detection of less than 10 radial degrees.

8. The device of claim 1, wherein said optical signalling means is visible from a distance of up to 300 yards.

9. The device of claim 1, wherein said optical signalling means is visible from a distance of up to 1000 yards.

10. The device of claim 1, wherein said optical signalling means is visible from a distance of up to 2000 yards.

11. The device of claim 1, wherein said one or more sensors are located below said surface of said housing and said detection means operates through said surface of said housing.

12. The device as claimed in claim 1, wherein the device further comprises a mailbox in which the device is contained and wherein said optical signalling means is mounted to an external surface of said mailbox.

13. A device for detecting and signalling the presence of an object in a closed container, comprising:

a housing;

one or more sensors each comprising an electronic circuit having a detection means and an optical signal triggering means, wherein said one or more sensors are coupled to said housing;

a power source electrically connected to said one or more sensors; and an optical signalling means electrically connected to said optical triggering means, wherein said optical signalling means comprises a high intensity LED having a shroud for increased security providing a decreased field of detection of less than 10 radial degrees.

14. The device as claimed in claim 13, wherein the device further comprises a mailbox in which the device is contained and wherein said optical signalling means is mounted to an external surface of said mailbox.

* * * * *